US007644689B2

(12) United States Patent
Tateno et al.

(10) Patent No.: US 7,644,689 B2
(45) Date of Patent: Jan. 12, 2010

(54) VARIABLE VALVE OPERATING DEVICE

(75) Inventors: Manabu Tateno, Sunto-gun (JP); Toshiaki Asada, Mishima (JP); Shuichi Ezaki, Susono (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 370 days.

(21) Appl. No.: 11/658,527

(22) PCT Filed: Aug. 30, 2005

(86) PCT No.: PCT/JP2005/016189

§ 371 (c)(1),
(2), (4) Date: Jan. 25, 2007

(87) PCT Pub. No.: WO2006/025569

PCT Pub. Date: Mar. 9, 2006

(65) Prior Publication Data

US 2008/0302320 A1 Dec. 11, 2008

(30) Foreign Application Priority Data

Aug. 31, 2004 (JP) ..... 2004-252562

(51) Int. Cl.
*F01L 1/34* (2006.01)

(52) U.S. Cl. ..... 123/90.16; 123/90.39; 74/569

(58) Field of Classification Search ..... 123/90.15, 123/90.16, 90.17, 90.18, 90.2, 90.27, 90.31, 123/90.39, 90.44; 74/559, 567, 569
See application file for complete search history.

(56) References Cited

FOREIGN PATENT DOCUMENTS

| | | |
|---|---|---|
| JP | A 6-093816 | 4/1994 |
| JP | A 6-307219 | 11/1994 |
| JP | A 7-063023 | 3/1995 |
| JP | A 11-036833 | 2/1999 |
| JP | A 2002-371816 | 12/2002 |
| JP | A 2003-239712 | 8/2003 |
| JP | A 2004-108302 | 4/2004 |
| JP | A 2004-225634 | 8/2004 |

*Primary Examiner*—Ching Chang
(74) *Attorney, Agent, or Firm*—Oliff & Berridge, PLC

(57) ABSTRACT

A variable valve operating device that makes it possible to reduce the loss in driving force transmission from a camshaft to a valve during a valve lift is provided. The rotary motion of a drive cam is transmitted to a swing member via intermediate rollers. A coupling member couples the intermediate rollers, to a swing fulcrum that is fastened to a control shaft. The swing fulcrum is positioned eccentrically to the center of the control shaft. Further, when the control shaft is positioned at a predetermined rotation position, the swing fulcrum is positioned so that the control shaft is placed between the swing fulcrum and the intermediate rollers. Preferably, the swing fulcrum, the control shaft, and the intermediate rollers are aligned.

5 Claims, 4 Drawing Sheets

VARIABLE VALVE OPERATING DEVICE

TECHNICAL FIELD

The present invention relates to a variable valve operating device for an internal combustion engine, and more particularly to a variable valve operating device that is capable of mechanically changing the operating characteristic of a valve.

BACKGROUND ART

A conventionally known variable valve operating device that is disclosed, for instance, by Japanese Patent Laid-open No. 2003-239712 mechanically changes the valve lift amount and valve timing in accordance with the operating state of an engine. In the variable valve operating device (hereinafter referred to as the conventional technology) described in Japanese Patent Laid-open No. 2003-239712, a control arm is fastened to a control shaft, which is positioned in parallel with a camshaft. One end of a follower is installed over the control arm and allowed to swing freely. A swing cam is installed over the control shaft and allowed to swing freely, and a rocker arm is pressed against a surface of the swing cam. A first roller and a second roller, which can rotate independently of each other, are concentrically installed over the follower. The first roller is in contact with a valve cam of the camshaft, whereas the second roller is in contact with a flat surface (contact surface) that is formed opposite the swing cam surface of the swing cam.

When the control shaft rotates to vary the rotation position of the control arm in a situation where the above configuration is employed, the follower becomes displaced to change the distance between the control shaft and the contact position between the swing cam and the second roller, thereby changing the lift amount of the valve. Further, when the circumferential position of the valve cam, which comes into contact with the first roller at the same rotation position of the camshaft, varies, the valve timing simultaneously changes. In other words, the conventional technology described in Japanese Patent Laid-open No. 2003-239712 is capable of simultaneously changing the valve's lift amount and valve timing by using a motor to control the rotation position of the control shaft.

Including the above-mentioned document, the applicant is aware of the following documents as a related art of the present invention.

[Patent Document 1]
Japanese Patent Laid-open No. 2003-239712
[Patent Document 2]
Japanese Patent Laid-open No. 2002-371816
[Patent Document 3]
Japanese Patent Laid-open No. Hei7-63023
[Patent Document 4]
Japanese Patent Laid-open No. 2004-108302

DISCLOSURE OF INVENTION

When the conventional technology described in Japanese Patent Laid-open No. 2003-239712 is used, the valve cam transmits a driving force to the swing cam via a roller. The roller swings around a fulcrum of the follower in accordance with the rotation of the valve cam. The swing cam then swings around the control shaft in coordination with the swing of the roller. In such an instance, the roller not only presses the contact surface of the swing cam but also rolls along the contact surface to move back and forth alternately. More specifically, while the roller is in contact with a cam base circle of the valve cam, the roller is positioned at a leading end of the contact surface of the swing cam. Therefore, when the valve cam rotates to lift the roller, the position of the roller on the contact surface of the swing cam moves toward the control shaft. When the roller reciprocates along the contact surface as described above, the rotary motion of the valve cam is separated into a swing of the swing cam and a reciprocating motion of the roller on the contact surface. This results in a decrease in the efficiency of driving force transmission from the camshaft to the valve.

The present invention has been made to solve the above problem. It is an object of the present invention to provide a variable valve operating device that is capable of reducing the driving force transmission loss between the camshaft and the valve.

The above object is achieved by a variable valve operating device according to a first aspect of the present invention. The variable valve operating device mechanically changes the operating characteristic of a valve relative to the rotation of a camshaft. The variable valve operating device comprises a drive cam installed over the camshaft; a control shaft that is positioned in parallel with the camshaft and capable of changing the rotation position continuously or stepwise; a swing member that is installed over the control shaft and allowed to swing around the control shaft; a swing cam surface that is formed on the swing member, comes into contact with a valve support member, which supports the valve, and presses the valve in a lifting direction; a slide surface that is formed on the swing member so as to face the drive cam; an intermediate roller that is positioned between the drive cam and the swing member and comes into contact with both the slide surface and a cam surface of the drive cam; a control member that is fastened to the control shaft and has a swing fulcrum at a position eccentric to the center of the control shaft; and a coupling member that supports the intermediate roller in such a manner as to permit free rotation and couples the intermediate roller to the swing fulcrum in such a manner as to permit free swinging; wherein, when the control shaft is positioned at a predetermined rotation position, the swing fulcrum is positioned opposite to the intermediate roller with respect to the control shaft.

When, in the first aspect of the present invention, the camshaft rotates, its rotary motion is transmitted from the cam surface of the drive cam to the slide surface of the swing member via the intermediate roller, and converted to a swing motion of the swing member. In such an instance, the rotation locus of the intermediate roller, which is centered around the swing fulcrum, deviates from the rotation locus of the slide surface, which is centered around the control shaft, due to the deviation between the swing fulcrum and control shaft. Thus, the intermediate roller reciprocates along the slide surface. When the control shaft is positioned at a predetermined rotation position, the first aspect of the present invention places the swing fulcrum so that the control shaft is positioned between the swing fulcrum and intermediate roller. This reduces the deviation between the rotation locus of the intermediate roller and the rotation locus of the slide surface, thereby inhibiting the intermediate roller's reciprocating motion along the slide surface. As a result, the valve can be lifted with high efficiency by reducing the driving force transmission loss between the camshaft and the valve.

Part of load that the intermediate roller receives from the drive cam is input to the swing fulcrum via the coupling member. The control shaft is torqued depending on the direction of load input to the swing fulcrum. Force that the intermediate roller receives from the drive cam varies with the rotation of the drive cam. Therefore, when torque is imparted to the control shaft, the magnitude of the imparted torque also varies with the rotation of the drive cam. When the torque imparted to the control shaft varies, the control shaft may twist to vary the rotation position, thereby decreasing the control accuracy. However, while the control shaft is positioned at a predetermined rotation position, the first aspect of the present invention positions the swing fulcrum opposite to the intermediate roller with respect to the control shaft. Since this reduces the torque that is imparted to the control shaft, the control shaft rotation position variation arising out of torque variation is inhibited. Consequently, the first aspect of the present invention makes it possible to exercise variable control over the operating characteristic of the valve with high accuracy.

According to a second aspect of the present invention, there is provided the variable valve operating device as described in the first aspect, wherein the swing fulcrum, the control shaft, and the intermediate roller are substantially aligned.

According to the second aspect of the present invention, the swing fulcrum, control shaft, and intermediate roller are substantially aligned. This minimizes the deviation between the rotation locus of the intermediate roller, which is centered around the swing fulcrum, and the rotation locus of the slide surface, which is centered around the control shaft. The intermediate roller's reciprocating motion along the slide surface is then minimized so that the valve can be lifted with high efficiency. Further, it is also possible to minimize the control shaft rotation position variation arising out of torque variation.

According to a third aspect of the present invention, there is provided the variable valve operating device as described in the first or second aspect, wherein the predetermined rotation position is a rotation position for giving the maximum lift to the valve.

At a rotation position for giving the maximum lift to the valve, the third aspect of the present invention positions the swing fulcrum so that the control shaft is placed between the swing fulcrum and the intermediate roller. This makes it possible to maximize the efficiency of driving force transmission from the camshaft to the valve when the maximum load is generated. Further, since the torque imparted to the control shaft is minimized, the control shaft rotation position variation arising out of torque variation is inhibited even when the maximum load is generated.

According to a fourth aspect of the present invention, there is provided the variable valve operating device as described in the first or second aspect, wherein the predetermined rotation position is the most frequently used rotation position.

At the most frequently used rotation position, the fourth aspect of the present invention positions the swing fulcrum so that the control shaft is placed between the swing fulcrum and the intermediate roller. This makes it possible to maximize the efficiency of driving force transmission from the camshaft to the valve in the most frequent situation. Further, it is also possible to minimize the control shaft rotation position variation arising out of torque variation in the most frequent situation.

BRIEF DESCRIPTION OF DRAWINGS

FIG. 2A shows a state prevailing when a valve is closed and FIG. 2B shows a state prevailing when the valve is open;

FIG. 3A shows a state prevailing when the valve is closed and FIG. 3B shows a state prevailing when the valve is open;

BEST MODE FOR CARRYING OUT THE INVENTION

An embodiment of the present invention will now be described with reference to FIGS. 1 to 5.

[Configuration of Variable Valve Operating Device According to Present Embodiment]

Figure 1:
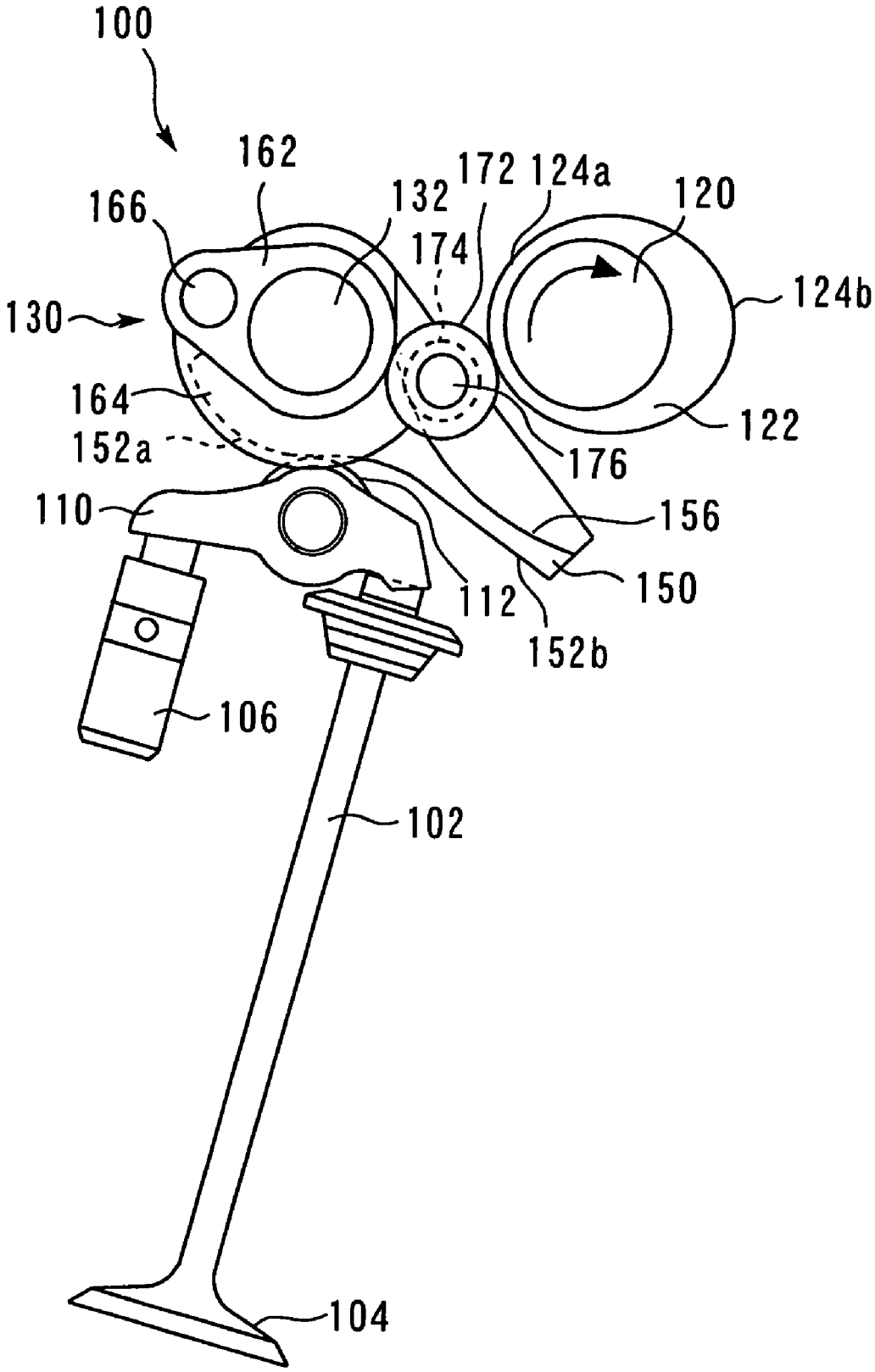
FIG. 1 is a side view illustrating the configuration of a variable valve operating device according to an embodiment of the present invention.

FIG. 1 is a side view illustrating the configuration of a variable valve operating device 100 according to an embodiment of the present invention. The variable valve operating device 100 includes a rocker arm type mechanical valve train. A drive cam 122, which is installed over a camshaft 120, converts a rotary motion of the camshaft 120 to a swing motion of a rocker arm (valve support member) 110. The swing motion of the rocker arm is then converted to a vertical lift motion of a valve 104 that is supported by the rocker arm 110. The drive cam 122 has two cam surfaces 124*a*, 124*b*, which differ in profile. One cam surface, which is a nonoperating surface 124*a*, is a circumferential surface of a cam base circle and formed at a fixed distance from the center of the camshaft 120. The other cam surface, which is an operating surface 124*b*, is formed so that the distance from the center of the camshaft 120 gradually increases and then gradually decreases after the apex. In this document, the term "drive cam surface 124" is used when the nonoperating surface 124*a* and operating surface 124*b* are not distinguished from each other.

In the variable valve operating device 100, the drive cam 122 does not directly drive the rocker arm 110. An adjustment mechanism 130 is positioned between the drive cam 122 and rocker arm 110. The adjustment mechanism 130 can continuously change the coordination between the rotary motion of the drive cam 122 and the swing motion of the rocker arm 110. The variable valve operating device 100 can exercise variable control over the adjustment mechanism 130 to vary the swing amount and swing timing of the rocker arm 110 and continuously change the lift amount and valve timing of the valve 104.

As described below, the adjustment mechanism 130 mainly comprises a control shaft 132, a control arm 162, a link arm 164, a swing cam arm 150, a first roller 172, and a second roller 174. The position of the control shaft 132 relative to the camshaft 120 is fixed so that the control shaft 132 is parallel to the camshaft 120. The rotation position of the control shaft 132 can be adjusted as desired by an actuator (e.g., motor) that is not shown.

The control arm 162 is fastened to the control shaft 132 in an integral manner. The control arm 162 projects radially from the control shaft 132, and the projection is provided with an arc-shaped link arm 164. A pin 166 is used to couple the trailing end of the link arm 164 to the control arm 162 so that the link arm 164 is allowed to rotate freely. The pin 166 is positioned eccentrically to the center of the control shaft 132 and serves as a swing fulcrum for the link arm 164.

The swing cam arm 150 is supported by the control shaft 132 and allowed to swing. The leading end of the swing cam arm 150 is positioned upstream in the rotation direction of the drive cam 122. A slide surface 156 that comes into contact with the second roller 174 is formed on the side on which the swing cam arm 150 faces the drive cam 122. The slide surface 156 is gradually curved toward the drive cam 122, and formed so that the distance between the drive cam 122 and cam base circle (nonoperating surface 124*a*) increases with an increase in the distance from the center of the control shaft 132, which is a swing center.

A swing cam surface 152 is formed on the side opposite the slide surface 156 of the swing cam arm 150. The swing cam surface 152 comprises a nonoperating surface 152*a* and an operating surface 152*b*, which have different profiles. The nonoperating surface 152*a* is a circumferential surface of the cam base circle and formed at a fixed distance from the center of the control shaft 132. The other surface, which is the operating surface 152*b*, is positioned toward the leading end of the swing cam arm 150, connected smoothly and contiguously to the nonoperating surface 152*a*, and formed so that the distance from the center of the control shaft 132 (that is, the cam height) gradually increases with a decrease in the distance to the leading end of the swing cam arm 150. In this document, the term "swing cam surface 152" is used when the nonoperating surface 152*a* and operating surface 152*b* are not distinguished from each other.

The first roller 172 and the second roller 174 are positioned between the slide surface 156 of the swing cam arm 150 and the drive cam surface 124 of the drive cam 122. The first roller 172 and the second roller 174 are both supported by a coupling shaft 176, which is fastened to the leading end of the link arm 164, and allowed to rotate freely. Since the link arm 164 can swing on the pin 166, the rollers 172, 174 can swing along the slide surface 156 and drive cam surface 124 while keeping a fixed distance from the pin 166. The drive cam 122 and swing cam arm 150 are displaced in axial direction. Therefore, the first roller 172 is in contact with the drive cam surface 124 and the second roller 174 is in contact with the slide surface 156.

The swing cam arm 150 is provided with a lost motion spring (not shown). The lost motion spring is a compression spring. The force of the lost motion spring not only presses the slide surface 156 against the second roller 174 but also presses the first roller 172, which is coaxial and integral with the second roller 174, against the drive cam surface 124. The first roller 172 and the second roller 174 are positioned by placing them between the slide surface 156 and drive cam surface 124.

The rocker arm 110 is positioned below the swing cam arm 150. The rocker arm 110 is provided with a rocker roller 112 that faces the swing cam surface 152. The rocker roller 112 is mounted on the middle of the rocker arm 110 and allowed to rotate freely. A valve shaft 102, which supports the valve 104, is mounted on one end of the rocker arm 110. The other end of the rocker arm 110 is supported by a hydraulic lash adjuster 106 and allowed to rotate freely. The valve shaft 102 is pushed by a valve spring (not shown) in closing direction, that is, in the direction of pushing up the rocker arm 110. This pushing force and the hydraulic lash adjuster 106 press the rocker roller 112 against the swing cam surface 152 of the swing cam arm 150.

FIG. 1 shows the variable valve operating device 100 that is placed in a state where the control shaft 132 is at a basic rotation position. In the present embodiment, the basic rotation position of the control shaft 132 prevails when the maximum lift is given to the valve 104. The control shaft 132 is adjusted from the basic rotation position to a rotation position for giving a smaller lift depending on the operating state of an internal combustion engine. While the control shaft 132 is at the basic rotation position, the pin 166, which serves as a swing fulcrum, is positioned so that the control shaft 132 is placed between the pin and the rollers 172, 174, and substantially aligned with the rollers 172, 174 and the axial center of the control shaft 132, as indicated in FIG. 1.

[Operations Performed by Variable Valve Operating Device According to Present Embodiment]

Operations performed by the variable valve operating device 100 will now be described with reference to FIGS. 2 to 5.

(1) Lift Operation of Variable Valve Operating Device

Figure 2B:
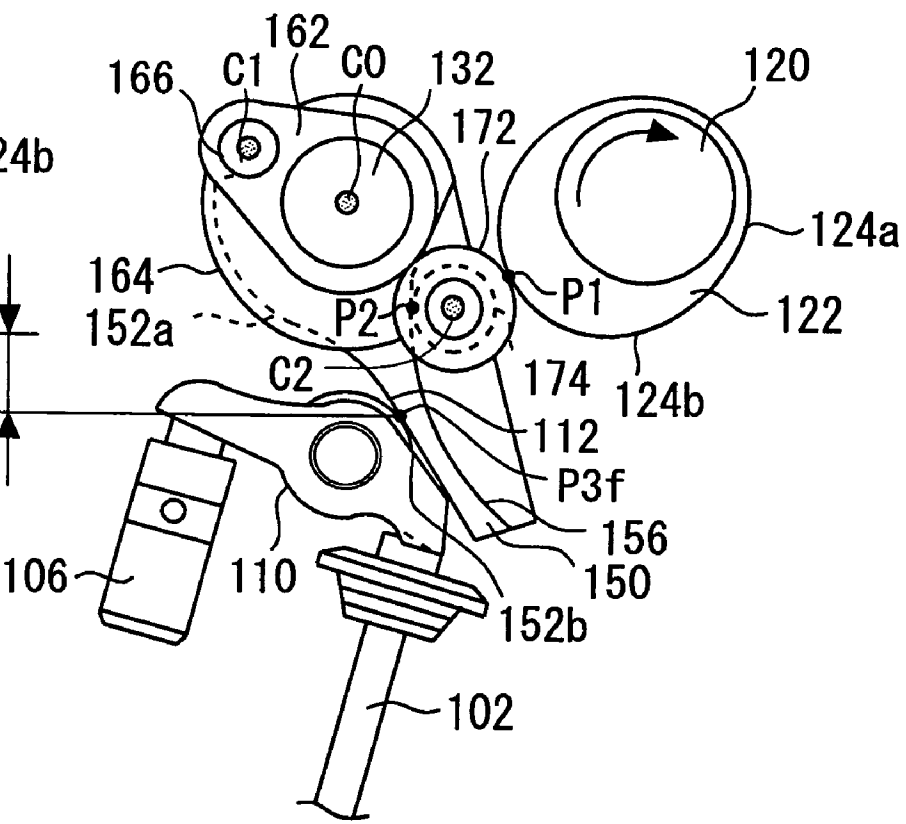
FIGS. 2A and 2B illustrate how the variable valve operating device operates during a great lift, and more particularly
Figure 2A:
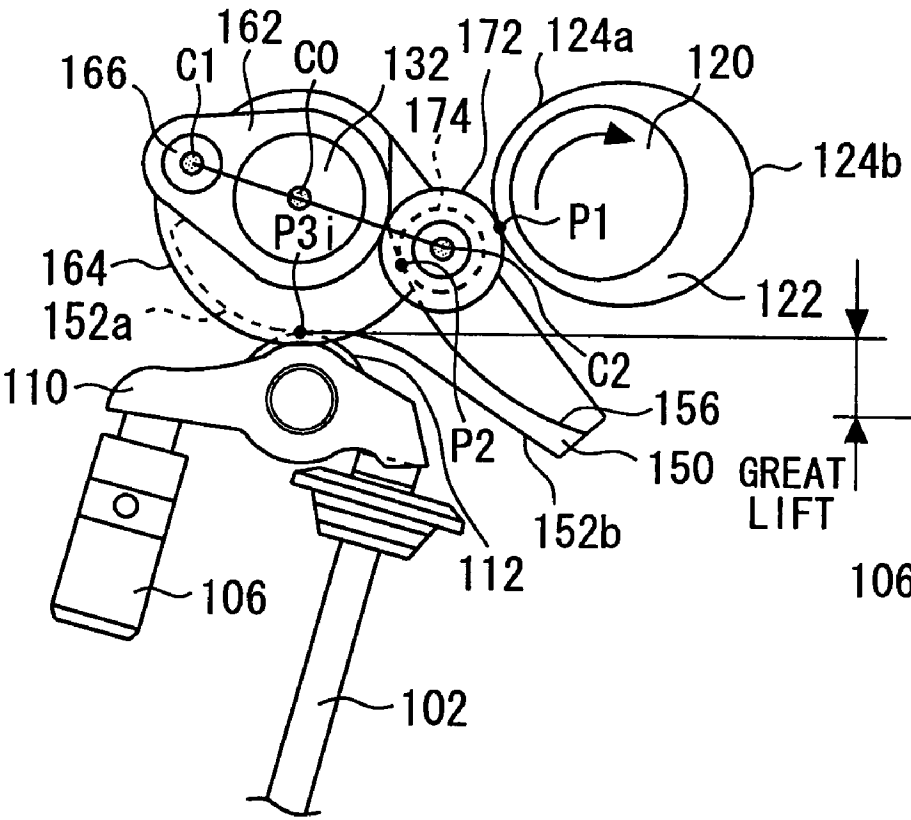

A lift operation performed by the variable valve operating device 100 will now be described with reference to FIGS. 2A and 2B. FIGS. 2A and 2B show a lift operation that the variable valve operating device 100 performs while the control shaft 132 is at the basic rotation position. FIG. 2A shows a state of the variable valve operating device 100 that prevails when the valve 104 (not shown in FIGS. 2A and 2B) is closed in a lift operation sequence. FIG. 2B shows a state of the variable valve operating device 100 that prevails when the valve 104 is open in the lift operation sequence.

In the variable valve operating device 100, the rotary motion of the drive cam 122 is first input to the first roller 172, which comes into contact with the drive cam surface 124. The first roller 172 and the second roller 174, which are coaxial and integral with each other, swing on the pin 166. The swing motion is input to the slide surface 156 of the swing cam arm 150, which supports the second roller 174. In this instance, there is a speed difference between the drive cam surface 124 and slide surface 156. However, since the two rollers 172, 174 can rotate independently, the friction loss in the transmission of a driving force is reduced. As the slide surface 156 is constantly pressed against the second roller 174 by the force of the lost motion spring (not shown), the swing cam arm 150 swings on the control shaft 132 in accordance with the rotation of the drive cam 122, which is transmitted via the second roller 174.

More specifically, when the camshaft 120 rotates in the state shown in FIG. 2A, the contact position P1 at which the first roller 172 contacts the drive cam surface 124 changes from the nonoperating surface 124*a* to the operating surface 124*b* as indicated in FIG. 2B. Relatively, the first roller 172 is pushed downward by the drive cam 122. Then, the slide surface 156 of the swing cam arm 150 is pushed downward by the second roller 174, which is integral with the first roller 172. This causes the swing cam arm 150 to turn clockwise, in FIGS. 2A and 2B, around the control shaft 132. When the camshaft 120 further rotates until the contact position P1 at which the first roller 172 contacts the drive cam surface 124 passes the apex of the operating surface 124*b*, the force generated by the lost motion spring and valve spring causes the swing cam arm 150 to turn counterclockwise, in FIGS. 2A and 2B, around the control shaft 132.

When the swing cam arm 150 turns around the control shaft 132, the contact position P3 at which the rocker roller 112 contacts the swing cam surface 152 changes. In FIGS. 2A and 2B, the contact positions at which the rocker roller 112 contacts the swing cam surface 152 are designated P3*i* and P3*f*. This is to distinguish between an initial contact position P3*i* and a final contact position P3*f*, which will be described later. In this document, the term "contact position P3" is simply used to represent the contact position at which the rocker roller 112 contacts the swing cam surface 152.

When the rocker roller 112 is in contact with the nonoperating surface 152*a* as indicated in FIG. 2A, the distance between the nonoperating surface 152*a* and the center of the control shaft 132 is fixed. Therefore, the position of the rocker roller 112 within the space remains unchanged without regard to the contact position. Consequently, a first rocker arm 110 does not swing so that the valve 104 is maintained at a fixed position. When the rocker roller 112 is in contact with the nonoperating surface 152*a*, the positional relationship among the components of the variable valve operating device 100 is adjusted so as to close the valve 104.

When the contact position P3 at which the rocker roller 112 contacts the swing cam surface 152 changes from the nonoperating surface 152*a* to the operating surface 152*b* as indicated in FIG. 2B, the first rocker arm 110 is pushed downward in accordance with the distance between the operating surface 152*b* and the center of the control shaft 132. This causes the first rocker arm 110 to swing clockwise around a point that is supported by the hydraulic lash adjuster 106. The valve 104 is then pushed downward and opened by the first rocker arm 110.

When the second roller 174 pushes down the slide surface 156 while the drive cam 122 rotates, the rotation locus of the second roller 174, which is centered around the pin 166, differs from the rotation locus of the slide surface 156, which is centered around the control shaft 132, because the pin 166 is eccentric to the control shaft 132. The contact position P2 at which the second roller 174 contacts the slide surface 156 moves along the slide surface 156 in accordance with the swing motion of the second roller 174 because of the rotation locus difference. When the amount of such movement increases, the loss in driving force transmission from the camshaft 120 to the valve 104 increases.

In the variable valve operating device 100 according to the present embodiment, however, the axial position C1 of the pin 166, which is a swing fulcrum, the axial position C0 of the control shaft 132, and the axial position C2 of the second roller 174 are substantially aligned as shown in FIG. 2A when the valve 104 closes with the control shaft 132 positioned at the basic rotation position. Therefore, the difference between the rotation locus of the second roller 174, which is centered around the pin 166, and the rotation locus of the slide surface 156, which is centered around the control shaft 132, is minimized when the valve 104 is lifted. Thus, the contact position P2 at which the second roller 174 contacts the slide surface 156 virtually remains unchanged as indicated in FIG. 2B. The lift amount of the valve 104 is maximized when the control shaft 132 is positioned at the basic rotation position. Therefore, the driving force transmitted from the drive cam 122 to the rollers 170, 172 is also maximized. The variable valve operating device 100 according to the present embodiment can minimize the loss in driving force transmission between the second roller 174 and slide surface 156 when the maximum driving force is generated as described above.

The driving force transmitted from the drive cam 122 to the rollers 170, 172 is partly input to the pin 166 via the link arm 164. The control shaft 132 is torqued depending on the direction of load input to the pin 166. The driving force transmitted from the drive cam 122 to the rollers 170, 172 varies in accordance with the rotation of the drive cam 122. Therefore, when torque is imparted to the control shaft 132, the magnitude of the imparted torque also varies with the rotation of the drive cam 122. When the torque imparted to the control shaft 132 varies, the rotation position of the control shaft 132 varies. Consequently, the operating characteristic of the valve 104 cannot be controlled with high accuracy.

In the variable valve operating device 100 according to the present embodiment, however, the axial position C1 of the pin 166, which is a swing fulcrum, the axial position C0 of the control shaft 132, and the axial position C2 of the second roller 174 are substantially aligned as mentioned earlier when the valve 104 closes with the control shaft 132 positioned at the basic rotation position. When the control shaft 132 is positioned at the basic rotation position, the lift amount of the valve 104 is maximized to maximize the load input to the pin 166. According to the variable valve operating device 100 according to the present embodiment, however, virtually no torque is imparted to the control shaft 132 because the line of action of load (the line joining the axial position C1 of the pin 166 to the axial position C2 of the second roller 174) passes through the axial position C0 of the control shaft 132. Consequently, the control shaft rotation position variation arising out of torque variation is minimized.

(2) Lift Amount Change Operation of Variable Valve Operating Device

Figures 3A, 3B:
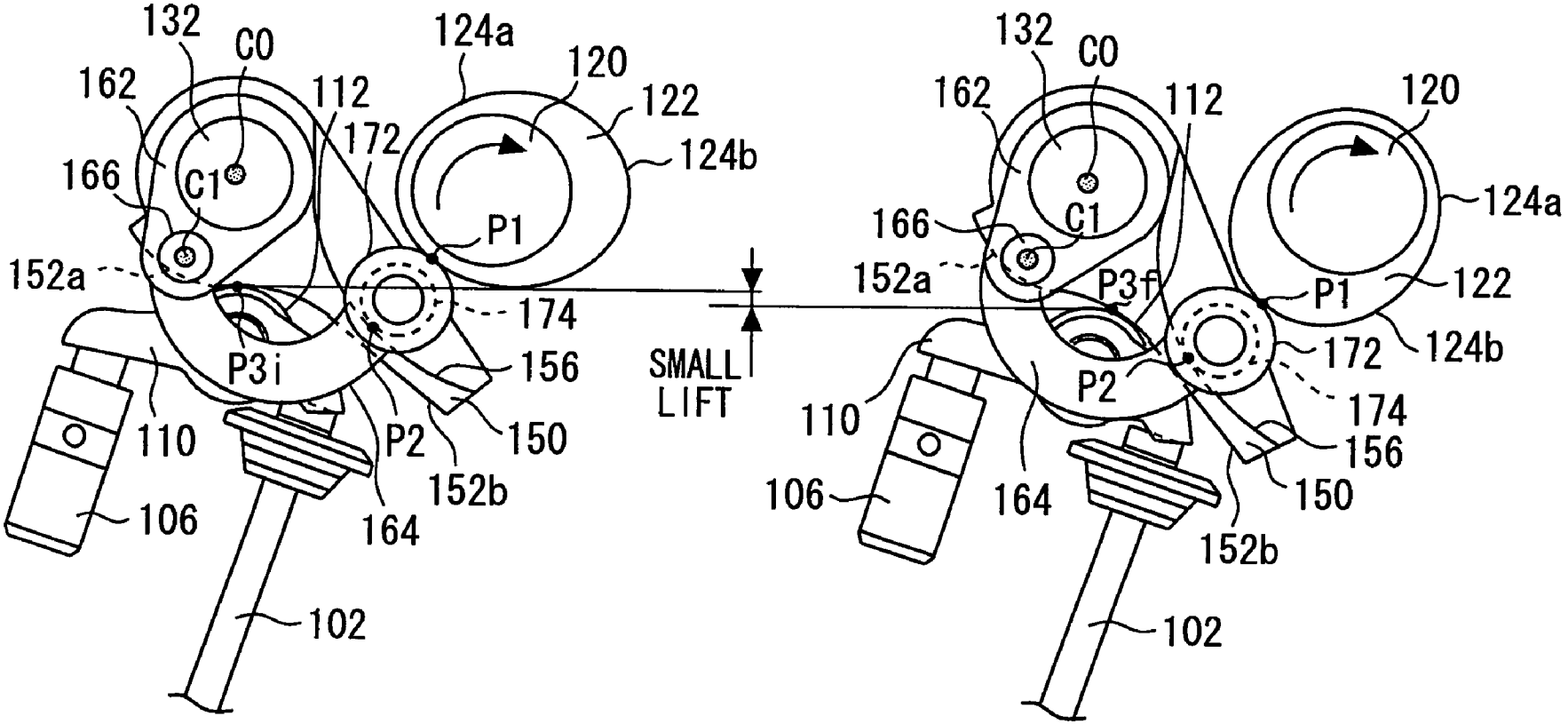
FIGS. 3A and 3B illustrate how the variable valve operating device operates during a small lift, and more particularly

A lift amount change operation performed by the valve 104 (see FIG. 1; not shown in FIGS. 2 and 3) of the variable valve operating device 100 will now be described with reference to FIGS. 2 and 3. FIGS. 3A and 3B illustrate an operation in which the variable valve operating device 100 gives a small lift to the valve 104. FIG. 3A shows a state of the variable valve operating device 100 that prevails when the valve 104 is closed in a lift operation sequence. FIG. 3B shows a state of the variable valve operating device 100 that prevails when the valve 104 is open in the lift operation sequence.

When the lift amount is to be changed from the lift amount shown in FIGS. 2A and 2B to the lift amount shown in FIGS. 3A and 3B, the control shaft 132 is rotated in a predetermined direction from the basic rotation position shown in FIG. 2A until the position C1 of the pin 166 rotates to the position shown in FIG. 3A. The first roller 172 and the second roller 174 are retained by the link arm 164 so that they are positioned at a predetermined distance from the position C1 of the pin 166. Therefore, when the position C1 of the pin 166 moves, the first roller 172 and the second roller 174 move from the positions shown in FIG. 2A to the positions shown in FIG. 3A. More specifically, the second roller 174 moves along the slide surface 156 and away from the control shaft 132 while the first roller 172 moves along the drive cam surface 124 and upstream in the direction of its rotation.

Figure 4:
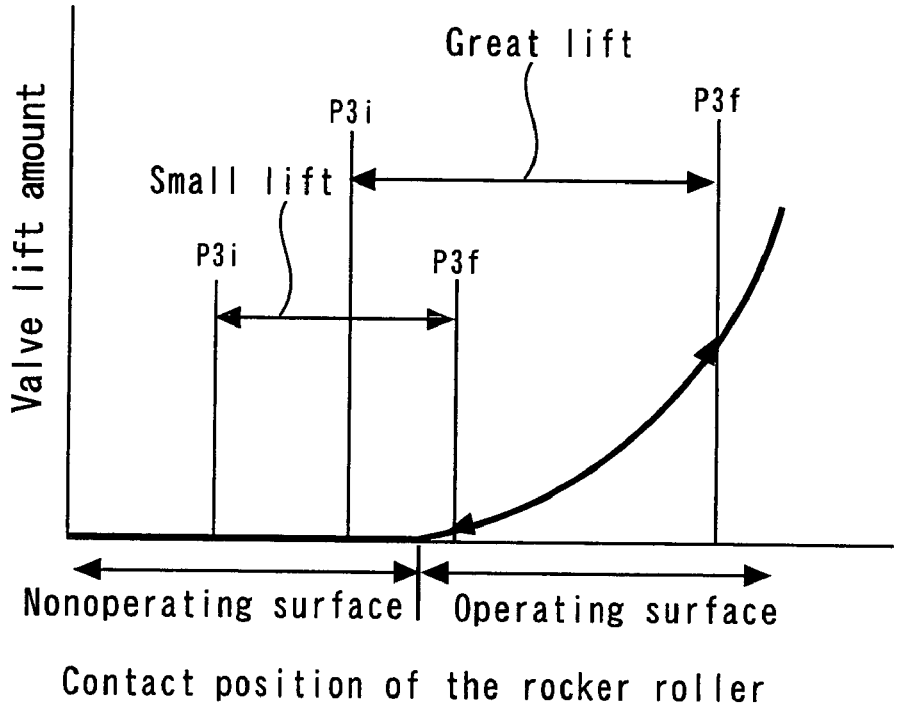
FIG. 4 shows the relationship between a valve lift amount and the position of a rocker roller on a swing cam surface.

When the second roller 174 moves away from the control shaft 132, the distance between the swing center C0 of the swing cam arm 150 and the contact position P2 at which the second roller 174 contacts the slide surface 156 increases, thereby decreasing the swing angle of the swing cam arm 150. The reason is that the swing angle of the swing cam arm 150 is in inverse proportion to the distance between the swing center C0 and an oscillation input point. As indicated in FIGS. 2B and 3B, the lift of the valve 104 is maximized when the contact position P1 at which the first roller 172 contacts the drive cam surface 124 is at the apex of the operating surface 124*b*, and the lift amount of the valve 104 is determined by the contact position P3*f* at which the rocker roller 112 contacts the swing cam surface 152 when the valve lift is maximized (hereinafter referred to as the final contact position). FIG. 4 illustrates the relationship between the valve lift and the position of the rocker roller 112 on the swing cam surface 152. As indicated in FIG. 4, the final contact position P3*f* is determined by the swing angle of the swing cam arm 150 and the contact position P3*i* at which the rocker roller 112 contacts the swing cam surface 152 as indicated in FIGS. 2A and 3A (hereinafter referred to as the initial contact position).

In the variable valve operating device 100 according to the present embodiment, the slide surface 156 is formed so that the distance to the cam base circle (nonoperating surface 124*a*) of the drive cam 122 increases with an increase in the distance to the swing center C0. Therefore, when the aforementioned contact position P2 moves away from the swing center C0 of the swing cam arm 150, the swing cam arm 150 inclines in such a direction that the slide surface 156 approaches the drive cam surface 124. The swing cam arm 150 turns counterclockwise around the control shaft 132 as viewed in the figures. This causes the initial contact position P3*i* of the rocker roller 112 on the swing cam surface 152 to move away from the operating surface 152*b* as indicated in FIG. 3A.

When the control shaft 132 rotates in a predetermined direction from the basic rotation position as described above, the swing angle of the swing cam arm 150 decreases and the initial contact position P3*i* moves away from the operating surface 152*b*. Consequently, the final contact position P3*f* that the rocker roller 112 can reach moves toward the nonoperating surface 152*a* as indicated in FIG. 4, thereby decreasing the lift amount of the valve 104. The operating angle of the valve 104 corresponds to a period (crank angle) during which the rocker roller 112 is positioned on the operating surface 152*a*. However, when the final contact position P3*f* moves toward the nonoperating surface 152*a*, the operating angle of the valve 104 also decreases. Further, the first roller 172 moves upstream in the rotation direction of the camshaft 120. Therefore, the contact position P1 at which the first roller 172 contacts the drive cam surface 124 when the camshaft 120 is at the same rotation position moves toward the advance angle side of the drive cam 122. This advances the swing timing of the swing cam arm 150 in relation to the phase of the camshaft 120. As a result, the valve timing (maximum lift timing) advances.

Figure 5:
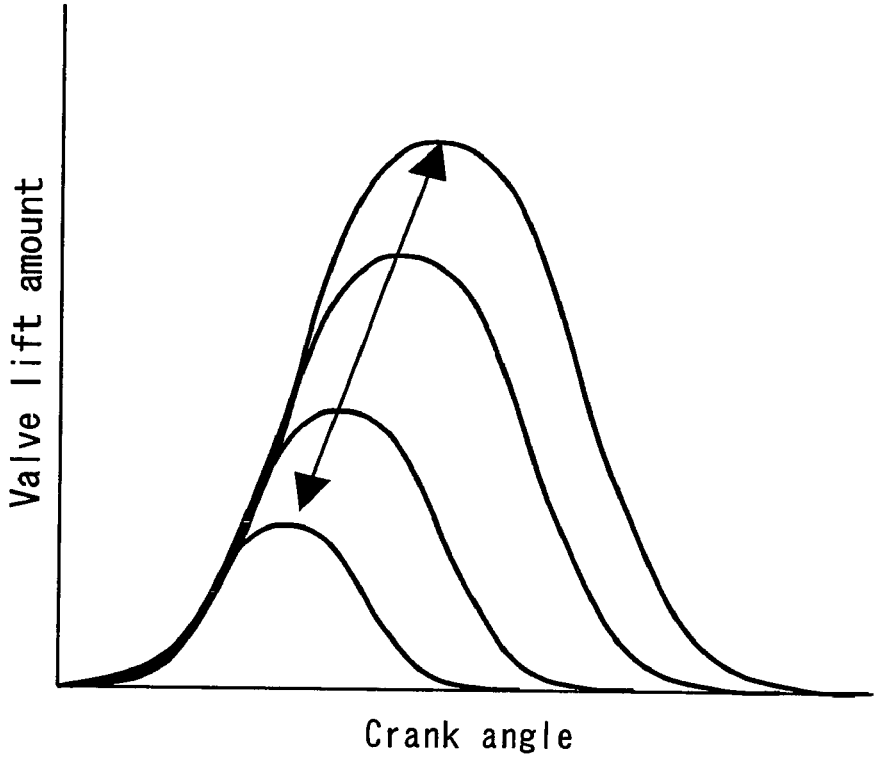
FIG. 5 shows the relationship between valve timing and lift amount.

FIG. 5 is a graph illustrating the relationship between the lift amount and valve timing of the valve 104, which are provided by the variable valve operating device 100. As shown in this figure, the variable valve operating device 100 can increase the operating angle and retard the valve timing when the lift amount of the valve 104 increases. Conversely, the variable valve operating device 100 can decrease the operating angle and advance the valve timing when the lift amount of the valve 104 decreases. Therefore, if, for instance, the valve 104 is an intake valve, it is possible to exercise variable control over the operating characteristic without using a VVT or other valve timing control mechanism so that the opening timing of the valve 104 remains virtually fixed.

[Advantages of Variable Valve Operating Device According to Present Embodiment]

As described above, the variable valve operating device 100 according to the present embodiment rotates the control shaft 132 to change the rotation position of a control cam 134, thereby changing the contact position P2 at which the second roller 174 contacts the slide surface and the contact position P1 at which the first roller 172 contacts the drive cam surface 124. As a result, the variable valve operating device 100 according to the present embodiment can change the lift amount, operating angle, and valve timing of the valve 104 in a coordinated manner.

Further, when the control shaft 132 is positioned at the basic rotation position, the axial position C1 of the pin 166, which is a swing fulcrum, the axial position C0 of the control shaft 132, and the axial position C2 of the second roller 174 are substantially aligned. Therefore, it is possible to inhibit the second roller 174 from reciprocating along the slide surface 156, which is caused by the rotation of the drive cam 122, and lift the valve 104 with high efficiency by reducing the loss in driving force transmission from the camshaft 120 to the valve 104. Furthermore, variable control can be exercised over the operating characteristic of the valve 104 with high accuracy because it is possible to inhibit the control shaft rotation position variation that would be caused by changes in the torque imparted to the control shaft 132.

[Other]

While the present invention has been described in terms of a preferred embodiment, it should be understood that the invention is not limited to the preferred embodiment, and that variations may be made without departure from the scope and spirit of the invention. For example, the embodiment described above applies the present invention to a rocker arm type valve operating device. However, the present invention can also be applied to a direct acting or other valve operating device.

The embodiment described above assumes that the rotation position for giving the maximum lift to the valve 104 is the basic rotation position of the control shaft 132. However, the rotation position for giving the minimum lift may alternatively be regarded as the basic rotation position. Another alternative is to regard an intermediate rotation position as the basic rotation position. Still another alternative is to regard the most frequently used rotation position as the basic rotation position. This makes it possible to maximize the efficiency of driving force transmission from the camshaft 120 to the valve 104 in the most frequent situation, and minimize the control shaft rotation position variation arising out of torque variation in the most frequent situation.

The invention claimed is:

1. A variable valve operating device for mechanically changing the operating characteristic of a valve relative to the rotation of a camshaft, the variable valve operating device comprising:

a drive cam installed over the camshaft;

a control shaft that is positioned in parallel with the camshaft and capable of changing a rotation position continuously or stepwise;

control means for controlling the control shaft so that it is fixed at a rotation position corresponding to a desired valve lift amount;

a swing member that is installed over the control shaft and allowed to swing around the control shaft;

a swing cam surface that is formed on the swing member, comes into contact with a valve support member, which supports the valve, and presses the valve in a lifting direction;

a slide surface that is formed on the swing member so as to face the drive cam;

an intermediate roller that is positioned between the drive cam and the swing member and comes into contact with both the slide surface and a cam surface of the drive cam;

a control member that is fastened to the control shaft and has a swing fulcrum at a position eccentric to the center of the control shaft; and a coupling member that supports the intermediate roller in such a manner as to permit free rotation and couples the intermediate roller to the swing fulcrum in such a manner as to permit free swinging;

wherein, the swing fulcrum is positioned closer to a position opposite to the intermediate roller with respect to the control shaft when the control shaft is fixed at a rotation position giving a large lift to the valve than when the control shaft is fixed at a rotation position giving a small lift to the valve.

2. The variable valve operating device according to claim 1, wherein, when the control shaft is positioned at a predetermined rotation position, the swing fulcrum, the control shaft, and the intermediate roller are substantially aligned.

3. The variable valve operating device according to claim 2, wherein the predetermined rotation position is a rotation position for giving the maximum lift to the valve.

4. The variable valve operating device according to claim 2, wherein the predetermined rotation position is a rotation position used for a longest duration of time.

5. A variable valve operating device for mechanically changing the operating characteristic of a valve relative to the rotation of a camshaft, the variable valve operating device comprising:

a drive cam installed over the camshaft;

a control shaft that is positioned in parallel with the camshaft and capable of changing a rotation position continuously or stepwise;

a swing member that is installed over the control shaft and allowed to swing around the control shaft;

a swing cam surface that is formed on the swing member, comes into contact with a valve support member, which supports the valve, and presses the valve in a lifting direction;

a slide surface that is formed on the swing member so as to face the drive cam;

an intermediate roller that is positioned between the drive cam and the swing member and comes into contact with both the slide surface and a cam surface of the drive cam;

a control member that is fastened to the control shaft and has a swing fulcrum at a position eccentric to the center of the control shaft; and a coupling member that supports the intermediate roller in such a manner as to permit free rotation and couples the intermediate roller to the swing fulcrum in such a manner as to permit free swinging;

wherein, when the control shaft is positioned at a rotation position used for a longest duration of time, the swing fulcrum is positioned opposite to the intermediate roller with respect to the control shaft.

* * * * *